US006230728B1

(12) United States Patent
Reese

(10) Patent No.: US 6,230,728 B1
(45) Date of Patent: May 15, 2001

(54) UMBRELLA-TYPE TENT APPARATUS AND METHOD

(76) Inventor: Frank P. Reese, 1194 Laird Ave., Salt Lake City, UT (US) 84105

( * ) Notice: Subject to any disclaimer, the term of this patent is extended or adjusted under 35 U.S.C. 154(b) by 0 days.

(21) Appl. No.: 09/491,370

(22) Filed: Jan. 26, 2000

(51) Int. Cl.[7] ..... E04H 15/28
(52) U.S. Cl. ..... 135/98; 135/20.3; 135/127
(58) Field of Search ..... 135/98, 20.3, 127

(56) References Cited

U.S. PATENT DOCUMENTS 5,333,634 * 8/1994 Taylor ..... 135/98
5,617,888 * 4/1997 Wu ..... 135/20.3
5,683,199 * 11/1997 Tehan ..... 135/127
5,711,333 * 1/1998 Vanderminden ..... 135/20.3
5,865,201 * 2/1999 Lin ..... 135/31
5,901,722 * 5/1999 Lee ..... 135/25.1
6,042,297 * 3/2000 Lah ..... 135/114
6,058,951 * 5/2000 Wilson ..... 135/20.3

* cited by examiner

*Primary Examiner*—Beth A. Stephan
(74) *Attorney, Agent, or Firm*—J. Winslow Young; Daniel McCarthy

(57) ABSTRACT

A support framework for an umbrella-type tent, the tent including a fabric tent shell suspended from the support framework. The top and center hubs for the support framework are fabricated from a suitable material so as to provide increased strength to the top hub and the center hub. The fabric tent shell is tethered to the support framework to limit slippage of the fabric tent shell down the tent poles. The tent poles are segmented so as to provide foldable tent poles. A bungee cord keeper system is incorporated into the upper coupling for the segmented tent pole.

20 Claims, 4 Drawing Sheets

UMBRELLA-TYPE TENT APPARATUS AND METHOD

BACKGROUND

1. Field of the Invention

This invention relates to umbrella-type tents and, more particularly, to an improved umbrella-type tent apparatus and method having a novel hub assembly system, a novel bungee cord retainer system for the poles, and a unique tether system for preventing the fabric of the tent shell from sliding too far down the pole as the umbrella-type tent is erected and/or collapsed.

2. The Prior Art

Tents have been well-known throughout history for use as a portable structure designed primarily to protect the inhabitants thereof from the elements. The simplest tent consisted of a flexible sheet of fabric or skins supported above the ground by a central tent pole with the periphery of the fabric held outwardly from the tent pole by a plurality of tent pegs. Such a structure is relatively simple to construct and to transport from place to place. The task of erecting this type of tent can be quite challenging since it involves maintaining the central tent pole in a vertical orientation while pulling the fabric outwardly and securing the periphery of the fabric with the tent pegs. Obviously, such a task requires two or more people in order for this type of tent to be erected in a satisfactory manner and in a reasonable period of time. Another shortcoming of this type of tent is that it customarily had no flooring.

It was recognition of these shortcomings that within the last few decades a new type of tent was created around the principle of an umbrella. This umbrella-type tent structure has the fabric of the tent shell slidably secured to the poles of the umbrella structure so that the step of opening the "umbrella" resulted in the poles being forced outwardly to create the support framework for the fabric enclosure of the tent. An integral fabric floor for the tent structure formed a tension member to restrain the ends of the poles of the umbrella. The poles are pivotally secured at their upper ends to an upper hub assembly and are sufficiently resilient to allow the poles to be formed into an arcuate shape thereby creating a domed appearance for the tent. Customarily, the poles are located in spaced relationship to the outer surface of the tent and are constrained inside narrow fabric loops sewn to the tent shell.

A series of lateral ribs extend outwardly from a center hub assembly with each rib being hingedly affixed to a respective tent pole. The length of the ribs and the location of their hinged attachment to the respective tent poles is such that raising the center hub creates an over center condition to hold the center hub upwardly and to cause the ribs to push the poles outwardly against the restraining action of the tent shell and integral floor. The foregoing action provides an umbrella-type tent that is easily erected and collapsed by the simple step of moving the center hub upwardly to raise the tent and downwardly to collapse the tent. Additional refinements include providing the tent with foldable poles. One common form of foldable pole is one having a plurality of hollow pole segments adapted to be received in an end-to-end relationship to create the extended pole. A bungee cord passing through the lumen of the hollow pole segments holds the pole segments together in this end-to-end relationship while allowing the pole segments to be disengaged and then placed into juxtaposition with the other pole segments. This folding capability enables one to reduce a relatively long tent pole to a shorter bundle of pole segments, the overall length of which is the overall length of the individual pole segments.

While umbrella-type tents have become rather ubiquitous, I have found a number of drawbacks to these types of tents. For example, both the top hub and the center hub, as can be readily observed from the foregoing description, are subjected to significant forces which will cause them to break, particularly hubs that are injection molded from plastic. Another problem is that when the umbrella-type tent is collapsed the fabric loops that engage the tent shell to the poles slide down the tent pole to a position that causes the loop to interfere with the smooth operation of the tent the next time the tent is erected. Customarily, the fabric loop slips below the upper coupling of the segmented tent pole and is thus momentarily snagged thereby. If the fabric loop binds on the tent pole instead of smoothly sliding up the tent pole as the tent is erected, there is a resultant tendency for the person erecting the tent to place excessive force on both the top hub and the center hub in an attempt to overcome this binding resistance of the fabric loop on the pole. This excessive force is also a contributory factor in breakage of the top hub and the center hub. I have also found that replacement of one of these broken hubs is quite complicated and frequently requires special tools to remove and replace the hubs. For example, roll pins or rivets have been used to hingedly secure the tent poles to the top hub as well as the ribs to the central hub, which means special tools are required in order to remove and replace a broken hub.

Another problem I have discovered is that of securing the bungee cord inside a fiberglass tent pole. By comparison, the bungee cord is typically secured inside the hollow lumen of, say, an aluminum tent pole segment, by the simple expedient of tying an overhand knot in the end of the bungee cord. The bulk of the overhand knot against a hollow insert is sufficient to prevent the bungee cord from being pulled through the hollow lumen of the aluminum tent pole. However, a fiberglass tent pole has a much smaller lumen due to the required increase in thickness of the sidewall of the fiberglass tent pole in order to impart to the fiberglass tent pole the necessary strength as compared to an aluminum tent pole. The end result is that there simply is not enough space in the lumen of a fiberglass tent pole to accommodate the knot.

In view of the foregoing it would be an advancement in the art to provide improvements in umbrella tent structures, particularly in the top hub and the center hub thereof and in the tethering of the fabric shell to the tent poles. It would also be an advancement in the art to provide both a top hub and a center hub that is stronger and readily repairable, if necessary, using a simple screw driver. Another advancement in the art would be to provide improvements in foldable fiberglass tent poles, particularly in the mechanism whereby the bungee cord is secured inside the fiberglass tent poles. Such a novel apparatus and method is disclosed and claimed herein.

BRIEF SUMMARY AND OBJECTS OF THE INVENTION

This invention is an improved umbrella-type tent apparatus and method having a number of unique features which significantly improve the structural integrity of the tent and the ease of erection and collapse of the tent. One important improvement is a novel hub system for the tent. Both the top hub and the center hub are fabricated from a suitable material such as a section of aluminum extrusion that has had its corners smoothed then drilled and tapped so that screws can be used to hingedly mount the ends of the tent poles to the top hub and the ribs to the center hub. Other suitable materials can include fiber-reinforced composites, other metals, ceramic, or polymer materials. A tether is included in the tent pole structure to serve as a retainer to prevent the upper fabric loops for the tent shell from sliding too far down the tent poles to a position that would cause the loops to bind on the tent poles during erection of the tent. An improved bungee cord retainer system is also provided for retaining the end of the bungee cord in the coupling for a foldable fiberglass tent pole.

It is, therefore, a primary object of this invention to provide improvements in umbrella-type tents.

It is another object of this invention to provide improvements in the method of fabricating an umbrella-type tent.

Another object of this invention is to provide improved hubs for an umbrella-type tent.

Another object of this invention is to provide a top hub and a center hub fabricated from a suitable material such as a section of extruded aluminum, the suitable material providing improved strength to the top hub and the center hub at a reduced cost.

Another object of this invention is to provide a top hub and a center hub having screws therein for hingedly securing the tent poles to the top hub and the ribs to the center hub.

Another object of this invention is to provide a tether system for preventing the upper fabric loops from sliding too far down the tent poles to a position that would otherwise interfere with erection of the umbrella-type tent.

Another object of this invention is to provide a novel securement mechanism for securing the end of a bungee cord for a foldable tent pole.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
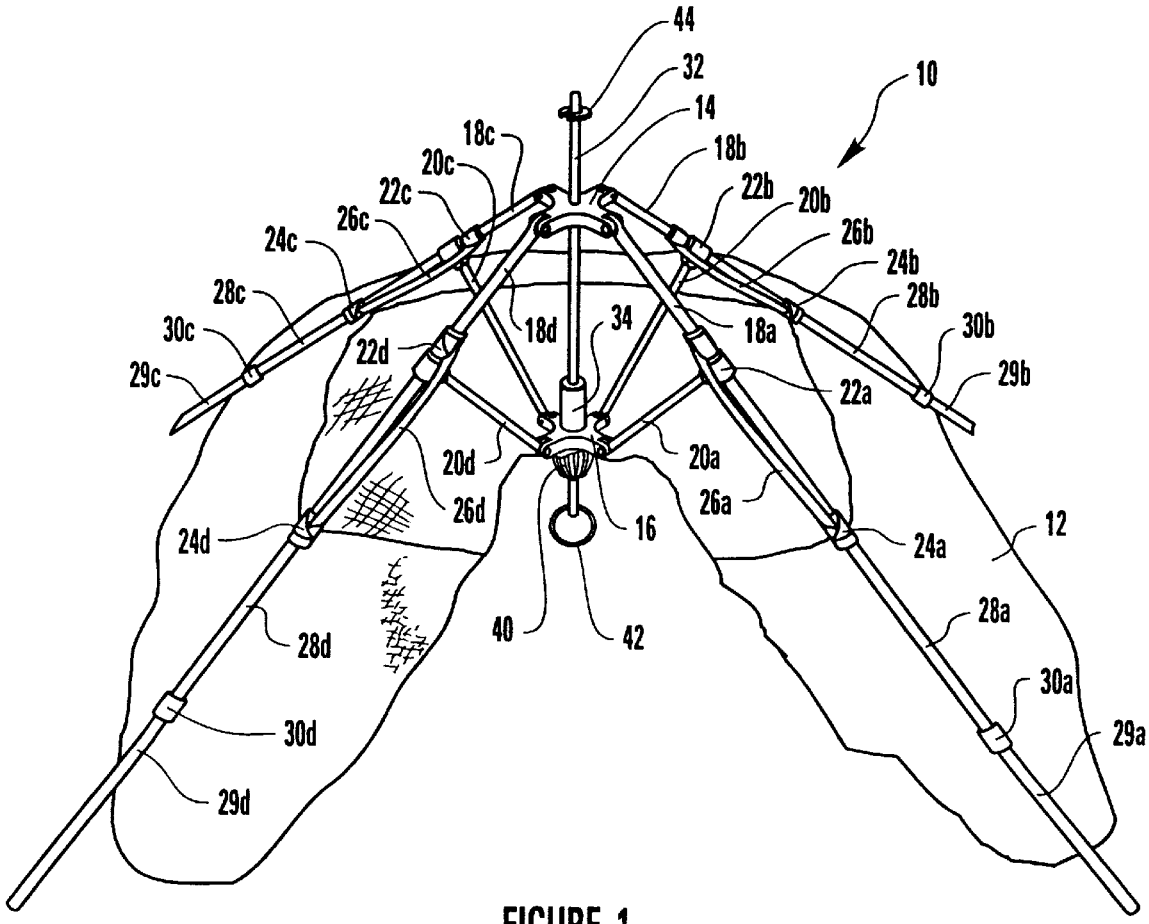
FIG. 1 is a perspective view of the upper portion of an umbrella-type tent showing my novel top hub and center hub along with the tether system, portions of the tent being broken away for ease of illustration.

The invention is best understood from the following description with reference to the drawing wherein like parts are designated by like numerals throughout and taken in conjunction with the appended claims.

General Discussion

The novel umbrella-type tent apparatus and method of my invention includes several unique features which, when combined, provide an umbrella-type tent that has stronger components at critical locations plus other features that render the tent easier to erect, sturdier when erected, and simpler to repair when necessary. One key element of my novel tent is in the hubs, both the top hub and the center hub. I have discovered that I can fabricate these elements from any suitable material such as metals, fiber-reinforced composites, plastic, ceramic, or polymer materials so long as the particular material of construction provides the necessary strength to suitably resist the forces imposed on the elements. One specific material that I have found to be especially useful is a discrete length of extruded aluminum. For example, I have found that a length of extruded aluminum to be far superior in strength as compared to the same element fabricated from an injection-molded plastic. The aluminum can also be machined to provide threaded bores for the receipt of screws, each screw providing a hinged anchorage for a tent pole in the case of the top hub and a rib in the case of the center hub. The use of screws enables the user to easily repair a pole or rib, as the case may be, in the event of damage to either of these elements. Aluminum has further advantages of not only being light weight but also is readily amendable to being anodized to provide almost any preselected color.

I have also found that it is highly desirable to tether the upper fabric loop of the tent shell to prevent the tent shell from sliding too far down the tent poles. In particular, when the umbrella mechanism is collapsed and the tent poles are brought inwardly, the fabric loops of tent shell slide downwardly over the tent poles with the upper fabric loop falling below the upper joint of the respective tent pole. Specifically, when the umbrella mechanism is brought to the collapsed position, the center hub is moved downwardly until the ribs are oriented nearly parallel to the poles which means that the center hub is lowered by a distance comparable to the length of the ribs. Since the apex of the tent shell is secured to the center hub, the adjacent, upper fabric loops by which the tent shell is slidably secured to the tent poles are also permitted to slide down the tent poles to a point below the upper joint of the respective tent pole. The positioning of the fabric loop at this location frequently results in the fabric loop becoming snagged behind by the joint during the erection of the tent since the forces exerted on the tent shell pull the fabric loop against the tent pole. This problem is particularly exacerbated by any moisture or dampness on the fabric loop in its contact with the tent pole.

Accordingly, I have discovered an elegant solution to this problem and that is to provide a tether between the fabric loop and the juncture of the tent pole and the respective rib. The length of the tether is configured to prevent the fabric loop from sliding beyond the upper joint in the tent pole. This tether can be either elastic or non elastic so long as it prevents the fabric loop from becoming snagged behind the joint.

My novel umbrella-type tent also includes a novel securement system for securing the end of the internal bungee cord inside the upper joint of a tent pole. While this securement system is necessitated for fiberglass tent poles, other types of tent poles could also benefit from its use. A conventional fiberglass tent pole has a hollow lumen which, due to the need to provide the fiberglass tent pole with sufficient strength, the wall thickness of the fiberglass tent pole is increased to such an extent that the resulting lumen is relatively small in diameter. I have found that the existing lumen is of such a small diameter that it will just barely receive a bungee cord through the lumen so that there simply is not enough room for a retaining knot to be tied in the end of the bungee cord to retain the bungee cord in place as is presently done when mounting a bungee cord in a hollow aluminum tent pole. As a result of this limitation involving fiberglass tent poles I have created a unique securement system for use in the upper joint of a fiberglass tent pole. The basic element of the joint is a hollow sleeve that is preferably fabricated from aluminum and has an internal diameter that snugly receives the respective ends of the fiberglass tent pole segments. A first set of detents is formed in the sleeve at a position about forty percent of the distance up the sleeve. A keeper configured as a short plug and having an external diameter incrementally less than the internal diameter of the sleeve is then dropped into the sleeve to a point where it rests against the lower set of detents. The keeper has a central bore therethrough for passage of the bungee cord. A simple overhand knot is tied in the end of the bungee cord and the knot rests against the keeper which thereby serves as a retainer for the end of the bungee cord. An upper set of detents is then formed in the sidewall of the sleeve about forty percent of the distance from the top of the sleeve to preclude the keeper from escaping from the sleeve. The lower end of the upper pole segment is then inserted into the upper end of the sleeve until it rests against the upper set of detents and is then securely bonded to the sleeve. The upper end of the middle pole segment is releasably inserted into the lower end of the sleeve until it abuts the lower set of detents. The elasticity of the bungee cord holds the ends of the tent pole segments into their respective sleeves to thereby provide a completed tent pole. Only the upper sleeve requires the retainer system since the upper end of the upper pole segment is hingedly engaged to the top hub by the use of sockets on the end at each upper pole segment.

Detailed Description

Referring now to FIG. 1, the improvements to the umbrella-type tent apparatus are shown generally at 10 as my novel support framework and are shown in the environment of a fabric tent shell 12, only a portion of which is shown herein for ease of presentation. Support framework 10 includes a top hub 14, a center hub 16, four tent poles 18*a*–18*d* hingedly engaged to the top hub 14, and four ribs 20*a*–20*d* hingedly engaged between tent poles 18*a*–18*d* and center hub 16. Four rib anchors 22*a*–22*d* are secured to tent poles 18*a*–18*d*, respectively, and serve as the hinged anchorage of the respective ribs 20*a*–20*d* to tent poles 18*a*–18*d*. Fabric tent shell 12 is slidingly mounted to tent poles 18*a*–18*d* by a plurality of fabric loops 24*a*–24*d*, respectively, only four of which are shown herein although other fabric loops (not shown) are positioned at spaced locations on fabric tent shell 12 along each of tent poles 18*a*–18*d* to provide the necessary connection between fabric tent shell 12 and tent poles 18*a*–18*d*. In this manner support framework 10 acts as an exoskeleton which supports fabric tent shell 12 outwardly to create thereby the umbrella-type tent for which my novel support framework 10 provides such an important function.

One of the novel features of my invention is a tether system for preventing fabric tent shell 12 from sliding too far down tent poles 18*a*–18*d*. Specifically, I have incorporated a plurality of tethers 26*a*–26*d* which are respectively engaged between rib anchors 22*a*–22*d* and the respective fabric loops 24*a*–24*d*. The length of tethers 26*a*–26*d* is selectively predetermined to limit the distance to which fabric loops 24*a*–24*d* are allowed to slide downwardly on tent poles 18*a*–18*d*. In particular, tent poles 18*a*–18*d* are each assembled from a plurality of pole segments which are shown herein as upper pole segments 28*a*–28*d* with middle pole segments 29*a*–29*d* joined at the lower end of upper pole segments 28*a*–28*d* at couplings 30*a*–30*d*, respectively. The functioning of couplings 30*a*–30*d* will be discussed more fully hereinafter in the description of coupling 30*a* at FIG. 5. As can be readily seen, couplings 30*a*–30*d* form fairly large protuberances on each of tent poles 18*a*–18*d* which protuberances create a place against which fabric loops 24*a*–24*d* can become snagged if fabric loops 24*a*–24*d* were allowed to slide downwardly across couplings 30*a*–30*d* and onto the surface of middle pole segments 29*a*–29*d*.

At this point one may query as to why not simply make the internal diameter of fabric loops 24*a*–24*d* of such a small diameter that it would be impossible for fabric loops 24*a*–24*d* to slide downwardly across couplings 30*a*–30*d*. However, the nature of the operational cooperation necessary between fabric loops 24*a*–24*d* requires that the internal diameter of fabric loops 24*a*–24*d* must be sufficiently large enough to account for the angular offset of the pulling force imposed upon fabric loops 24*a*–24*d* as fabric tent shell 12 is pulled upwardly during erection of support framework 10; otherwise, fabric loops 24*a*–24*d* would bind against the external surface of tent poles 18*a*–18*d*.

From the foregoing it is clear that tethers 26*a*–26*d* provide a novel and unexpected improvement to the operation of support framework 10 in that tethers 26*a*–26*d* retain fabric loops 24*a*–24*d* above the respective couplings 30*a*–30*d* so that fabric tent shell 12 may be more easily raised upon erection of support framework 10. The absence of tethers 26*a*–26*d* would result in the operator (not shown) being required to free each of fabric loops 24*a*–24*d* from its respective coupling 30*a*–30*d* while simultaneously holding sufficient erectile tension on support framework 10 to prevent fabric tent shell 12 from falling downwardly to a position that would allow the remainder of fabric loops 24*a*–24*d* to again become snagged behind the respective coupling 30*a*–30*d*. Clearly, a requirement for the operator to conduct such cumbersome dual activities is unduly burdensome. My novel tether system using tethers 26*a*–26*d* completely eliminates this difficulty.

Tethers 26*a*–26*d* are selectively fabricated from any suitable, flexible material such as a strip of fabric, string, flat elastic, or the like. When using a resilient material such as a flat elastic for tethers 26*a*–26*d*, great care should be taken to assure that the elasticity of the same does not allow any of fabric loops 24*a*–24*d* to drop below the respective couplings 30*a*–30*d* when support framework 10 is folded; otherwise, the entire value of the tether system provided by tethers 26*a*–26*d* would be lost.

Figure 4:
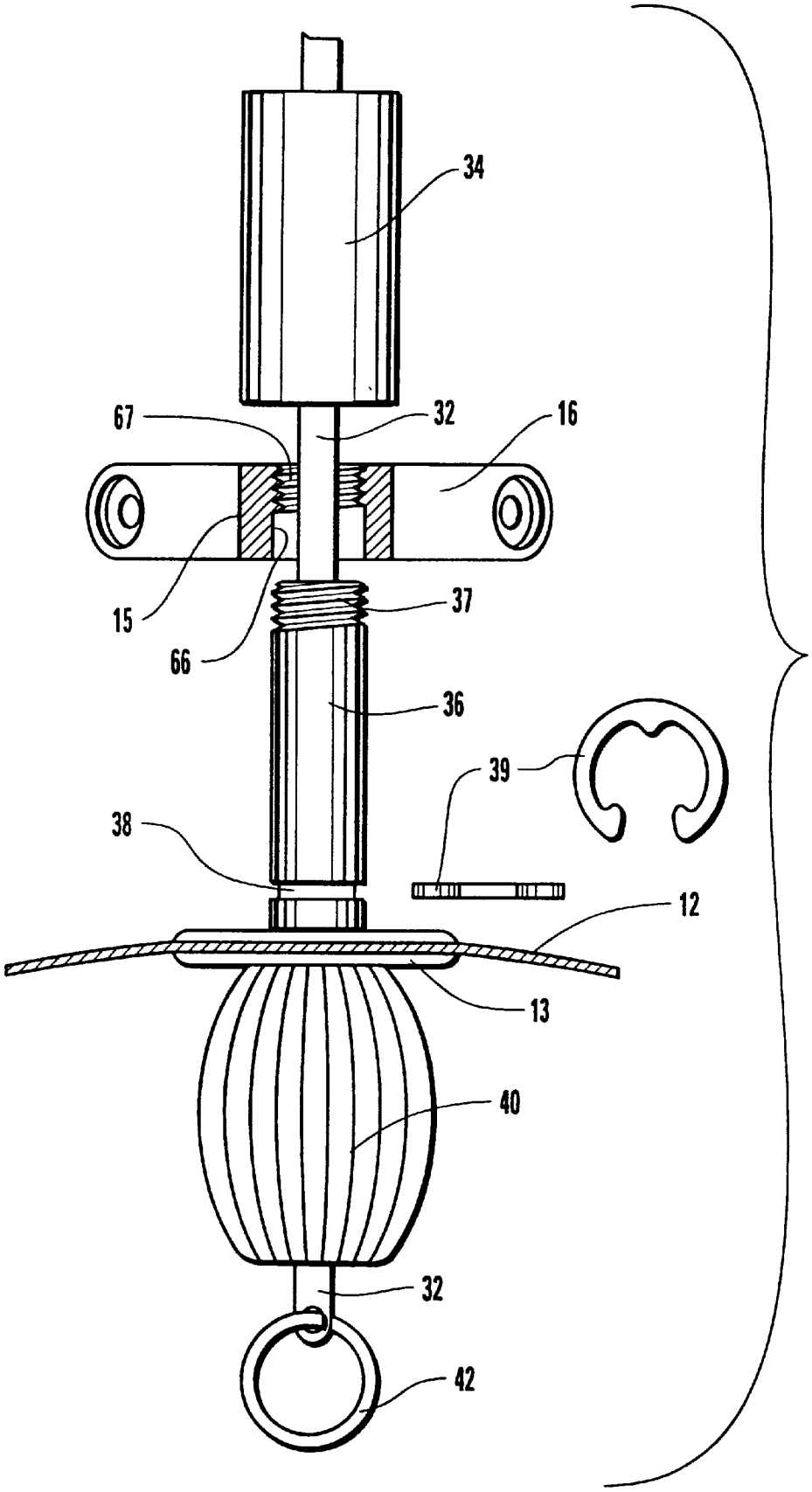
FIG. 4 is an enlarged, side elevation of the center hub assembly shown partially assembled to illustrate the relationship between the center hub and the fabric shell.

Referring now also to FIG. 4, support framework 10 also includes an axial strut 32 which serves as the "mast" for the umbrella function of the umbrella-type tent of which support framework 10 provides the structural framework. Axial strut 32 is movable vertically and is freely slidable through top hub 14 as well as center hub 16. Axial strut 32 acts as a tension member to allow the operator to force center hub 16 upwardly toward top hub 14 while pulling top hub 14 downwardly by pulling on axial strut 32 during the erection of support framework 10. This upward motion of center hub 16 in conjunction with the downward movement of top hub 14 causes ribs 20*a*–20*d* to force tent poles 18*a*–18*d* outwardly thereby creating the exoskeletal framework to support fabric tent shell 12 in its expanded or erected orientation. Continued upward movement of center hub 16 into the proximity of top hub 14 places center hub 16 and ribs 20*a*–20*d* in an over center orientation so that the inwardly directed tensile forces generated by tent poles 18*a*–18*d* being distorted outwardly causes center hub 16 to be forced upwardly toward top hub 14 thereby releasably holding center hub 16 upwardly so that support framework 10 remains in its erected orientation. Pulling center hub 16 downwardly brings center hub 16 across this over center orientation and allows support framework 10 to be collapsed. The foregoing up and down movement of center hub 16 is accomplished with the assistance provided by a axial strut 32.

A spacer 34 is slidingly mounted to axial strut 32 above center hub 16 and provides a limiting mechanism for limiting the distance by which center hub 16 can approach top hub 14. This is an important feature since the placement of center hub 16 into juxtaposition with top hub 14 would drastically reduce the degree by which ribs 20*a*–20*d* extend tent poles 18*a*–18*d,* respectively, outwardly and thus severely reduce the outward, spatial confines of support framework 10.

A bushing 36 is threadedly engaged to center hub 16 to provide a rigid interconnection between bushing 36 and center hub 16. In particular, a throughbore 66 in center hub 16 has threads 67 formed at the upper end of throughbore 66. The external diameter of bushing 36 is designed to be snugly received in telescopic relationship in throughbore 66. Threads 37 on the upper end of bushing 36 are designed to threadedly engage threads 67 to thereby securely interlock bushing 36 with center hub 16. This feature provides a solid interlocking relationship between center hub 16 and bushing 36. The lower end of bushing 36 includes a circumferential groove 38 into which a snap ring 39 is removably mounted. Bushing 36 supports a grommet 13 mounted in fabric tent shell 12 as well as a handle 40 while snap ring 39 secures grommet 13 and handle 40 on bushing 36. In this manner bushing 36 serves to form center hub 16, grommet 13, and handle 40 as an integral unit. A retainer 42 on the bottom end of axial strut 32 prevents axial strut 32 from being pulled upwardly out of bushing 36. A simple roll pin 44 is passed through the upper end of a axial strut 32 to secure the upper end of axial strut 32 against being pulled downwardly through top hub 14. Roll pin 44 also provides the stop against the top hub 14 so that the necessary tensile forces can be exerted downwardly against top hub 14 while forcing center hub 16 upwardly, as has been described hereinbefore, to erect support framework 10.

Figure 2:
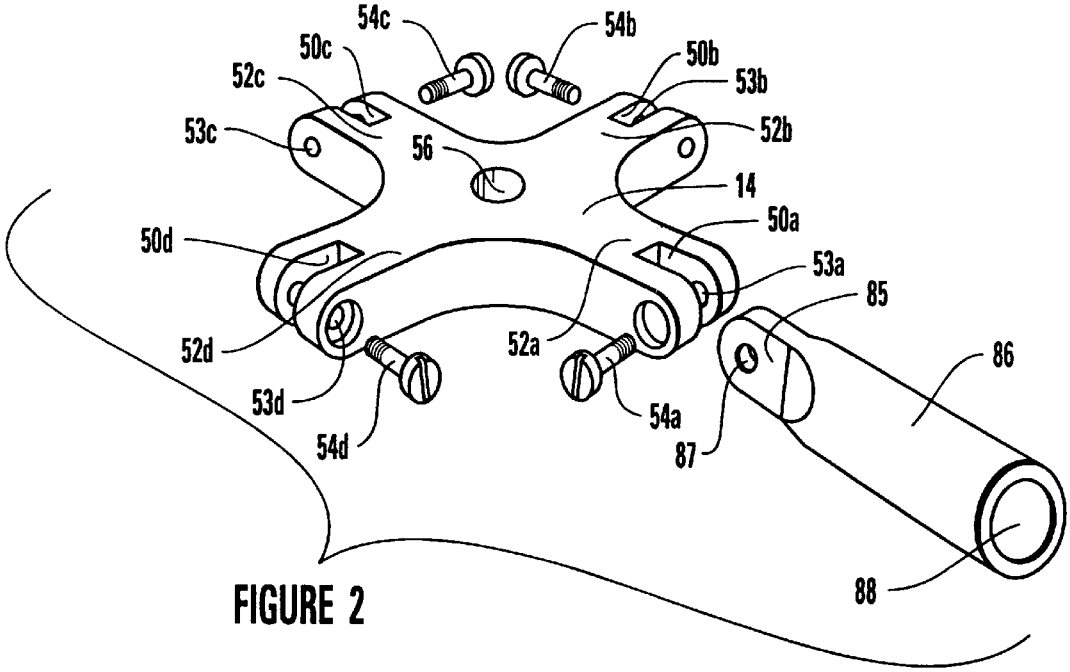
FIG. 2 is an enlarged, exploded perspective view of the top hub of FIG. 1 showing one of the tent pole sockets.

Referring now to FIG. 2, top hub 14 is shown as a planar element having a generally X-shaped configuration with hinge slots 50*a*–50*d* in the ends of each of the four arms 52*a*–52*d* of the X-shape. Arms 52*a*–52*d* each have a transverse throughbore 53*a*–53*d* therethrough to accommodate screws 54*a*–54*d* being threadedly engaged therein. Screws 54*a*–54*d* provide the hinge-type engagement between top hub 14 and the upper ends of the respective tent poles 18*a*–18*d* which are received in pivot slots 50*a*–50*d.* A central throughbore 56 in top hub 14 slidingly receives axial strut 32.

Top hub 14 is shown having an elongated, X-shaped configuration, a configuration useful for providing support framework 10 for a tent structure having a rectangular floor plan (not shown). However, top hub 14 can also be configured as an equilateral, X-shaped configuration in order to provide support framework 10 for a tent structure having a square floor plan. Correspondingly, top hub 14 can be configured with six of arms 52 to provide support framework 10 for a tent structure having a hexagonal floor plan. Clearly, of course, the same basic elements described hereinbefore would be essential elements of top hub 14, regardless of the particular configuration of top hub 14. Further, center hub 16 would be identical in configuration in order to match the particular tent design established by the selection of the particular profile of top hub 14.

Top hub 14 also includes a plurality of sockets 86, only one of which is shown herein for ease of presentation, for the hinged joinder of tent poles 18*a*–18*d* to top hub 14. Socket 86 includes a tongue 85 adapted to be received in hinge slot 50*a*. A hole 87 in tongue 85 receives screw 54*a* which forms the pivot pin about which socket 86 hingedly rotates. Tent pole 18*a* (FIG. 1) is telescopically inserted into lumen 88 of socket 86 and is securely bonded therein to secure tent pole 18*a* to top hub 14.

Figure 3:
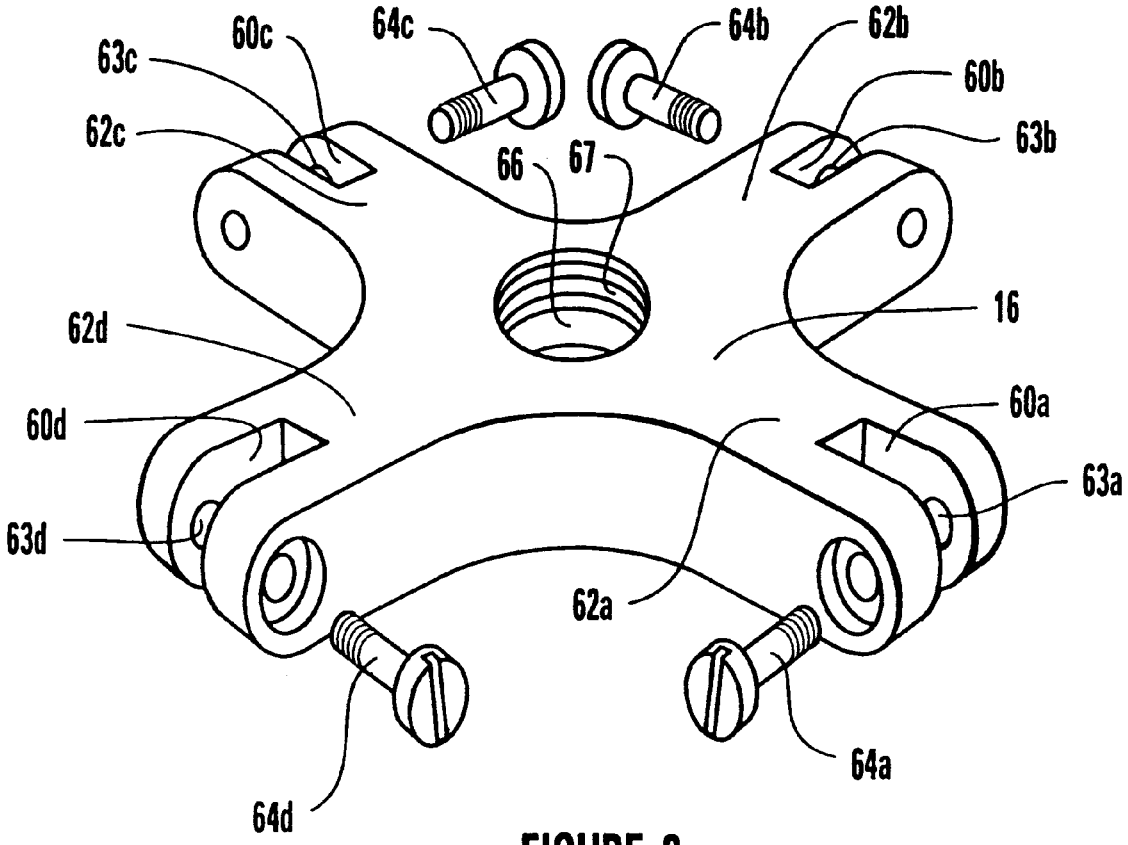
FIG. 3 is an exploded, enlarged perspective view of the center hub of FIG. 1 with portions broken away to disclose internal features.

Referring now to FIG. 3, center hub 16 is also shown as a planar element having a generally X-shaped configuration corresponding to top hub 14 with hinge slots 60*a*–60*d* in the ends of the four arms 62*a*–62*d* of the X-shape. Arms 62*a*–62*d* each have a transverse throughbore 63*a*–63*d* therethrough to accommodate screws 64*a*–64*d* being threadedly engaged therein. Screws 64*a*–64*d* provide the hinge-type engagement between center hub 16 and the respective ribs 20*a*–20*d.* Central throughbore 66 receives bushing 36 (FIG. 4) with threads 37 of bushing 36 securely engaging threads 67 at the upper end of central throughbore 66. At this juncture, it should be pointed out that top hub 14 is identical in profile to center hub 16 except that central throughbore 66 is larger in diameter than central throughbore 56 in order to receive bushing 36 therein. Further, each of screws 54*a*–54*d* are identical to screws 64*a*–64*d* to accommodate interchangeability of parts.

Preferentially, both top hub 14 and center hub 16 are fabricated from discrete lengths of extruded aluminum, the length being the thicknesses of top hub 14 and center hub 16, although other suitable materials such as plastic, fiber-reinforced composites, other metals, ceramic, or polymer materials can be used for this application. After being cut from the extruded aluminum the various corners and edges are suitably polished and shaped to provide top hub 14 and center hub 16 with a smooth profile. Advantageously, even though top hub 14 and center hub 16 are fabricated from extruded aluminum I have found that the overall cost of the same is comparable to that of an injection molded plastic but with a superior strength. Further, aluminum lends itself admirably to the use of screws whereas plastic requires some other form of fastener. Screws are simpler to use, replace, and are readily interchangeable.

Figure 5:
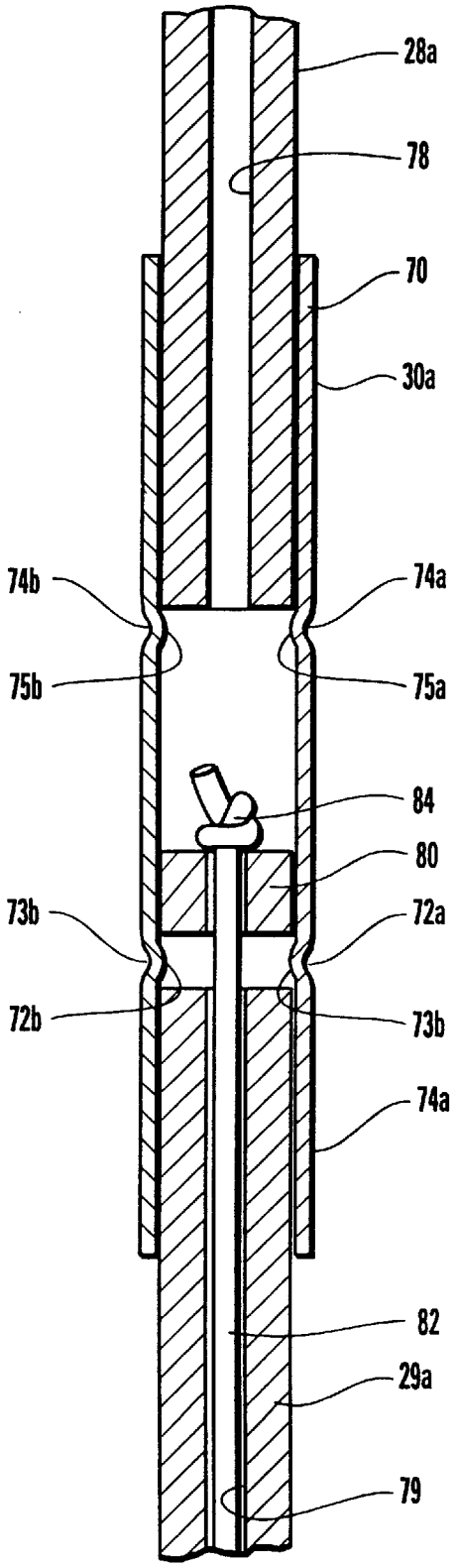
FIG. 5 is an enlarged, cross-sectional view of my novel bungee cord retainer system shown in the environment of a tent pole.

Referring now to FIG. 5, coupling 30*a* is shown greatly enlarged in this cross-sectional view in order to more clearly illustrate the novel features of this portion of my invention. coupling 30*a* is configured as a hollow, tubular sleeve 70 having an internal diameter selectively predetermined to slidingly receive therein the bottom end of upper pole segment 28*a* and the upper end of middle pole segment 29*a*. Sleeve 70 is preferably fabricated from aluminum or other suitable material so as to be sufficiently malleable to accommodate being selectively deformed as described herein. In particular, a plurality of detents 72*a* and 72*b* are deformably shaped into the sidewall of sleeve 70 to create stops 73*a* and 73*b* on the interior surface of sleeve 70. With the formation of stops 73*a* and 73*b* a keeper 80 is threaded on the end of a bungee cord 82. A knot 84 is then formed in the end of bungee cord 82. Bungee cord 82 is then threaded downwardly through sleeve 70 to bring keeper 80 against stops 73*a* and 73*b*. Bungee cord 82 is also threaded through hollow lumen 79 in middle pole segment 29*a*. Bungee cord 80 is secured at a position below other pole segments, if any, (not shown) below middle pole segment 29*a* and placed under tension thereby. Middle pole segment 29*a* is removably engaged in sleeve 70 by being pulled upwardly therein by the tensile force exerted by bungee cord 82. Stops 73*a* and 73*b* not only prevent keeper 80 from being pulled out of sleeve 70 but also act as an abutment against which middle pole segment 29 is pulled by the tension on bungee cord 82. Middle pole segment 29*a* is removable from coupling 30*a* by the step of pulling downwardly on middle pole segment 29*a* to stretch bungee cord 82 and then folding bungee cord 82 to bring middle pole segment upwardly into juxtaposition with and parallel to upper pole segment 28*a*.

Coupling 30*a* is completed by deformably creating a plurality of upper detents 74*a* and 74*b* in the sidewall of sleeve 70. Interiorly, upper detents 74*a* and 74*b* become upper stops 75*a* and 75*b*. The bottom end of upper pole segment 28*a* is inserted into sleeve 70 and into engagement against upper stops 75*a* and 75*b*. Upper pole segment 28*a* is then suitably bonded to sleeve 70 to thereby complete coupling 30*a*.

At this point it should be noted that even though upper pole segment 28*a* does include a hollow lumen 78, no bungee cord is included therein. This is because the upper end of upper pole segment 28*a* is mounted in socket 86 (FIG. 2) which, in turn, is hingedly secured to top hub 14 so that there is no provision or even need for securing bungee cord 82 at that location due to the nature of the hinged connection with top hub 14. It was for this reason that I devised my novel coupling assembly as shown herein at coupling 30*a*. In particular, by using keeper 80 I am able to incorporate bungee cord 82 as the tensile member that allows me to easily erect and/or collapse and fold my novel umbrella-type tent with minimal effort.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A support framework for an umbrella-type tent comprising:

a top hub and a plurality of tent poles hingedly engaged to said top hub, said top hub being fabricated with a generally X-shaped profile, said X-shaped profile having a plurality of outwardly extending arms, each of said arms having a hinge slot and a transverse throughbore across said hinge slot, said hinge slot receiving an end of a socket for supporting said tent pole in hinged relationship to said top hub, said top hub including a screw in each of said transverse throughbores, said screw serving as a hinge pin for said hinged relationship between said top hub and said socket of said tent pole;

a center hub, said center hub being fabricated with said generally X-shaped profile of said top hub with said outwardly extending arms, each of said arms having an extending arm hinge slot and a transverse throughbore across said hinge slot, an extending arm hinge slot receiving an end of a rib in hinged relationship with a screw in said transverse throughbore, said screw serving as a hinge pin for said hinged relationship between said center hub and said rib;

a rib anchor on each tent pole, said rib anchor providing a hinged relationship between said rib and said tent pole;

a fabric tent shell; and a plurality of fabric loops.

2. The support framework defined in claim 1 wherein said top hub and said center hub are fabricated from discrete lengths of extruded aluminum.

3. The support framework defined in claim 1 wherein said tent poles are fabricated from a plurality of tent pole segments releasably joined in an end-to-end relationship at couplings between said tent pole segments, an upper coupling comprising a hollow sleeve formed into an upper tent pole socket and a lower tent pole socket with a keeper housing between said upper tent pole socket and said lower said lower tent pole socket, said upper coupling including a keeper in said keeper housing, said keeper providing securement means for securing an end of a bungee cord passing through a lumen of said tent pole segments below said upper coupling.

4. The support framework defined in claim 3 wherein said tent poles are fabricated from fiberglass having a diametrally reduced lumen therethrough.

5. The support framework defined in claim 1 wherein said support framework includes a tether means which can be used to tether said fabric tent shell to said support framework.

6. The support framework defined in claim 5 wherein said tether means comprises a tether, said tether being fabricated from a strip of fabric.

7. The support framework defined in claim 6 wherein said tether is connected to said support framework at said rib anchor and to said fabric tent shell at said fabric loop.

8. The support framework defined in claim 7 wherein said tether has a predetermined length.

9. The support framework defined in claim 5 wherein said tether means comprises a tether fabricated from an elastic cord.

10. A support framework for an umbrella-type tent comprising:

a top hub;

a plurality of segmented tent poles secured to said top hub in a hinged relationship;

a rib anchor on each of said tent poles;

a center hub;

a plurality of ribs hingedly connected at a first end to said tent poles at said rib anchor, said ribs being hingedly connected at a second end to said center hub;

a fabric tent shell;

a plurality of fabric loops; and tether means for limiting slippage of said fabric loops downwardly across said tent poles when said support framework is oriented to a folded position.

11. The support framework defined in claim 8 wherein said top hub and said center hub are each cut from a length of extruded aluminum substrate.

12. The support framework defined in claim 11 wherein said extruded aluminum substrate includes an X-shaped profile having a plurality of arms, an end of each of said arms including a hinge slot for receipt therein of an end of a socket for said tent pole in the case of said top hub and said second end of said rib in the case of said center hub, said arms having a transverse throughbore for receipt of a screw, said screw serving as a hinge pin in said hinge slot.

13. The support framework defined in claim 10 wherein said segmented tent poles are fabricated from fiberglass pole segments, a plurality of said fiberglass pole segments being joined in an end-to-end relationship at a coupling between each of said fiberglass pole segments to form said tent pole, an upper coupling on said tent pole including a bungee cord anchor means for anchoring an end of a bungee cord passing through a lumen of said fiberglass pole segments.

14. The support framework defined in claim 13 wherein said bungee cord anchor means comprises a keeper enclosed within said upper coupling.

15. The support framework defined in claim 14 wherein said upper coupling comprises an upper socket, a lower socket, and a keeper housing between said upper socket and said lower socket, said upper socket receiving a lower end of an upper fiberglass pole segment, said lower socket receiving an upper end of a lower fiberglass pole segment with said bungee cord passing from said keeper through said lower fiberglass pole segment.

16. A method for providing a support framework for a fabric tent shell of an umbrella-type tent structure, said support framework including a plurality of segmented tent poles and a fabric tent shell suspended from said segmented tent poles, comprising the steps of:

fabricating a top hub and a center hub;

hingedly joining an upper end of each of said segmented tent poles to said top hub;

hingedly mounting a first end of a rib to each of said segmented tent poles;

hingedly securing a second end of each of said ribs to said center hub;

mounting fabric loops to said fabric tent shell;

suspending said fabric tent shell from said segmented tent poles by passing said segmented tent poles through said fabric loops; and limiting slippage of said fabric tent shell down said segmented tent poles by tethering said fabric tent shell to said support framework with a tether means.

17. The method defined in claim 16 wherein said fabricating step includes preparing said top hub and said center hub from an extruded aluminum and smoothing and anodizing said extruded aluminum of said top hub and said center hub.

18. The method defined in claim 16 wherein said hingedly joining step includes fabricating said segmented tent poles as fiberglass tent pole segments, said fiberglass tent pole segments having a diametrally reduced lumen.

19. The method defined in claim 18 wherein said fabricating step includes providing a bungee cord anchor means in an upper coupling of each of said segmented tent poles.

20. The method defined in claim 19 wherein said fabricating step includes forming said upper coupling with an upper socket, a keeper housing, a keeper inside said keeper housing, and a lower socket, said segmented tent pole having a bungee cord passing downwardly from said keeper through each of said fiberglass tent pole segments below said upper couplings, said bungee cord being secured by said keeper.

* * * * *